United States Patent [19]

Stauffacher

[11] Patent Number: 4,586,423

[45] Date of Patent: May 6, 1986

[54] CARTRIDGE BELT AND BELT LINKS THEREFOR

[75] Inventor: Werner Stauffacher, Effretikon, Switzerland

[73] Assignee: Werkzeugmaschinenfabrik, Oerlikon-Bührle AG, Zürich, Switzerland

[21] Appl. No.: 514,971

[22] Filed: Jul. 18, 1983

[30] Foreign Application Priority Data

Aug. 3, 1982 [CH] Switzerland ..... 4673/82

[51] Int. Cl.[4] ..... F42B 39/08

[52] U.S. Cl. ..... 89/35.02; 89/35.01

[58] Field of Search ..... 89/35 A, 33.14, 33.17, 89/35.02

[56] References Cited

U.S. PATENT DOCUMENTS

| | | | |
|---|---|---|---|
| 2,373,288 | 4/1945 | Becker | 89/35.02 |
| 2,392,280 | 1/1946 | Youngren | 89/35.02 |
| 2,426,527 | 8/1947 | Sanford et al. | 89/35.02 |
| 2,475,380 | 7/1949 | Elder | 89/35.02 |
| 2,480,972 | 9/1949 | Sanford et al. | 89/35.02 |
| 2,714,333 | 8/1955 | Dixon | 89/35 A |
| 2,829,562 | 4/1958 | La Rue | 89/35.02 X |

FOREIGN PATENT DOCUMENTS 2126294 7/1977 Fed. Rep. of Germany .

*Primary Examiner*—David H. Brown
*Attorney, Agent, or Firm*—Werner W. Kleeman

[57] ABSTRACT

The belt links are constituted by a clamp member and a link member and serve to assemble together a series of cartridges to form a cartridge belt. Each cartridge is engaged or embraced by the guide member of one belt link, on the one hand, and by the link member of an adjacent belt link, on the other hand. In consideration of the infeed of the cartridges to a firing weapon the engaging or embracement angle, i.e. the overlap of the interfitting and superimposed guide and link members should be small. However, in order to prevent the cartridge belt from unintentionally disintegrating during kinking or buckling, there are provided stops or abutments at the clamp member and at the link member, by means of which the pivoting movement of the link member relative to the clamp member is limited.

8 Claims, 4 Drawing Figures

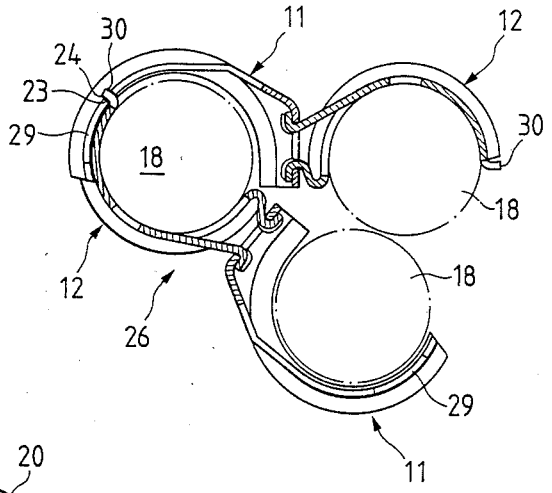
FIG. 4
FIG. 3
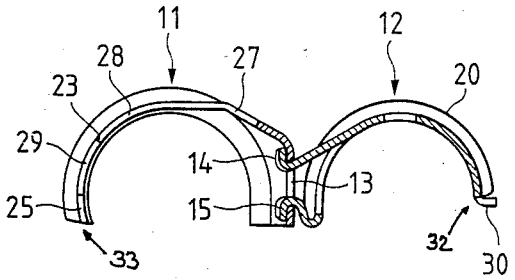
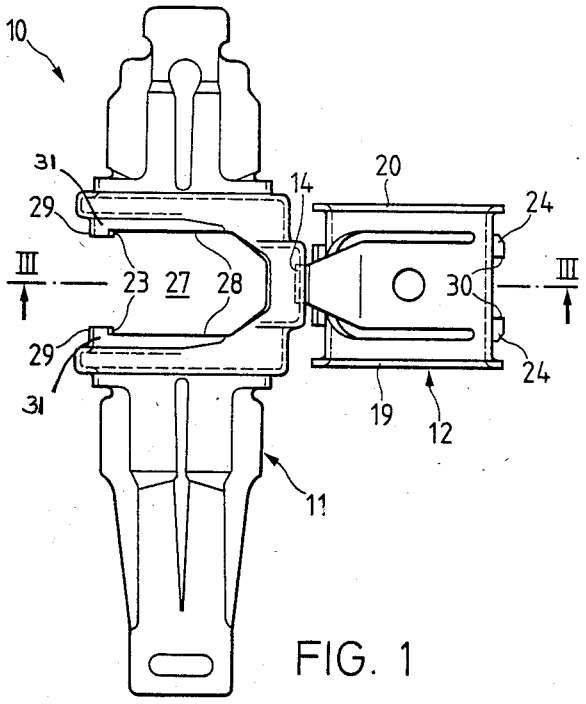
FIG. 1
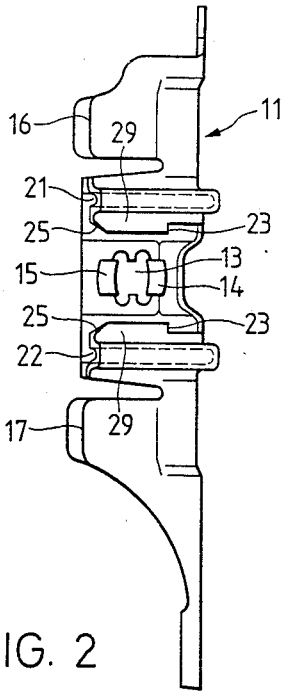
FIG. 2

CARTRIDGE BELT AND BELT LINKS THEREFOR

BACKGROUND OF THE INVENTION

The present invention relates to a new and improved belt link for use with a cartridge belt which is of the self-disintegrating type, and also relates to a new and improved cartridge belt composed of a plurality of adjacently interlinked or interfitted belt links.

In its more specific aspects, the invention concerns a new and improved belt link for use with a cartridge belt in which each belt link is constituted by a clamp member and a link member. Each cartridge in the cartridge belt is engaged by the link member of one belt link and the clamp member of an adjacent belt link. The link member has an outer cylindrical surface and the clamp member has an inner cylindrical surface. During buckling or kinking of the cartridge belt about the lengthwise axis of the cartridge the outer cylindrical surface of the link member is pivotably guided at the inner cylindrical surface of the clamp member.

In a belt link as known, for example from German Pat. No. 2,126,294, published Dec. 7, 1972, the clamp member as well as the link member possess a wide overlap or fitting interengagement with the cartridge, i.e., the belt links embrace the cartridge through an angle substantially greater than 180°, so as to ensure that the cartridge belt will not unintentionally disintegrate upon buckling. On the other hand, such a wide overlap obstructs the ammunition infeed to a firing weapon.

SUMMARY OF THE INVENTION

Therefore, with the foregoing in mind it is a primary object of the present invention to provide a new and improved belt link for use with a cartridge belt in which the link member as well as the clamp member embrace the cartridge only to a small extent, i.e., the overlap or engagement between the two members of the cartridge belt and the cartridge embraced or encircled thereby is relatively small.

Another important object of the present invention is directed to the provision of a new and improved belt link for use with a cartridge belt in which, despite the small overlap between the cartridge and the related link member and clamp member, there is no risk that the cartridge belt assembled from such belt links will disintegrate when extensively or markedly buckled.

Yet a further noteworthy object of the present invention is to provide a new and improved construction of cartridge belt of the self-disintegrating type, which is formed of releasably interfitted belt links, which cartridge belt is relatively simple in its construction and design, easy to assemble from such belt links, highly reliable in operation, and allows for positive retention of the cartridges of the cartridge belt and reliable infeed of such cartridges to a firing weapon.

A further noteworthy object of the present invention is directed to a new and improved construction of belt link for use with a cartridge belt of the self-disintegrating type, which belt link is relatively simple in construction and design, quite economical to manufacture, easy to assemble into the cartridge belt, and affords reliable retention of the related cartridges in the belt links and infeed of such cartridges in an unobstructed and positive manner to a firing weapon.

Now in order to implement these and still further objects of the invention, which will become more readily apparent as the description proceeds, the belt link of the present development is manifested by the features that, the degree or amount of pivoting movement of the link member relative to the clamp member is restricted by coacting stops or abutments formed at the clamp member and at the link member.

As alluded to above, the invention is not only concerned with the aforementioned belt link for use in a cartridge belt, but also relates to a novel construction of a cartridge belt assembled from such belt links. Generally speaking, the inventive cartridge belt is composed of a plurality of adjacently interlinked belt links, each belt link comprising a clamp member and a link member. Each cartridge held in the cartridge belt is engaged by the link member of one belt link and the clamp member of an adjacent belt link. The link member of each belt link has an outer cylindrical surface and the clamp member thereof has an inner cylindrical surface. The outer cylindrical surface of the link member of one belt link is pivotably guided at the inner cylindrical surface of the clamp member of an adjacent belt link when the cartridge belt is buckled or kinked about the cartridge axis of the cartridge held in such overlapping and interfitting clamp and link members. Furthermore, coacting stops or abutments formed at the clamp member and at the link member restrict the pivotal movement of the link member and clamp member relative to one another.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a top plan view of a belt link constructed according to the present invention;

FIG. 2 is a side view of the belt link shown in FIG. 1;

FIG. 3 is a sectional view taken substantially along the line III—III of the belt link shown in FIG. 1; and FIG. 4 is a sectional view showing the fitting interengagement of one belt link and an adjacent belt link as shown in FIG. 1 of a cartridge belt constructed according to the present invention.

DETAILED DESCRIPTION OF THE PREFERRED EMBODIMENTS

Describing now the drawings, it is to be understood that only enough of the construction of the inventive cartridge belt assembled from the belt links of the invention has been shown as needed for those skilled in the art to readily understand the underlying principles and concepts of the present development, while simplifying the showing of the drawings. Turning attention now specifically to FIGS. 1 to 4, there has been illustrated therein a belt link 10 constituted by a clamp member 11 and a link member 12 which resiliently interengages with the clamp member 11. The two members 11 and 12 are non-releasably interconnected with one another whereby a limited flexibility of a cartridge belt, generally indicated by reference character 26 in FIG. 4, composed of cartridges 18 and such belt links 10 is ensured.

In accordance with FIG. 2 the clamp member 11 comprises an opening 13 into which two resilient hooks 14 and 15 of the link member 12 lockingly protrude. The locking or connecting hooks 14 and 15 are more clearly illustrated in FIG. 3. Furthermore, the clamp member 11, as shwon in FIG. 2, comprises two clamps or clamp portions 16 and 17 which can embrace or partially engagingly encircle a cartridge 18 as shown in FIG. 4. In accordance with such FIG. 4 the link member 12 also engages cartridge 18. This link member 12 has an outer cylindrical surface and comprises two ribs or projections 19 and 20 formed at the outer cylindrical surface, see FIG. 1. These ribs 19 and 20 each advantageously possess an approximately semi-circular configuration. The clamp member 11 has an inner cylindrical surface which comprises recesses or grooves 21 and 22, as shown particularly in FIG. 2. These recesses or grooves 21 and 22 likewise have an approximately semi-circular configuration and define tracks or the like which receive the ribs 19 and 20 of a link member 12 of an adjacent belt link 10 as will be explained more fully hereinafter.

In the assembly of the cartridge belt from the aforementioned belt links 10, the ribs 19 and 20 formed at the outer cylindrical surface of the link member 12 of one belt link 10 project into the recesses 21 and 22, respectively, formed at the inner cylindrical surface of a clamp member 11 present at an adjacent belt link 10. The belt link 10, as described so far, does not basically differ from known constructions of belt links. According to the invention, however, the clamp member 11 comprises two stops or abutments 23, on the one hand, and the link member 12 comprises two stops or abutments 24, on the other hand. Due to the interaction of the stops or abutments 23 and of the stops or abutments 24 a displacement of the link member 12 of one belt link 10 relative to the clamp member 11 of an adjacent belt link 10 is restricted as will be evident from FIG. 4.

As will be specifically recognized from FIGS. 3 and 4, the clamp members 11 as well as the link members 12 contactingly embrace the related cartridge 18 through an angle which is only slightly greater than 180°, and the link member 12 embraces the cartridge 18 through a slightly lesser angular extent than the clamp member 11. Consequently, the danger of a belt link 10 being unintentionally stripped from the cartridge 18 is substantially greater, particularly that the link member 12 which embraces the cartridge 18 to a lesser extent is stripped-off. However, the danger of the belt link 10 being unintentionally stripped-off the cartridge 18 is effectively prevented by the aforementioned stops or abutments 23 and 24. There is especially prevented that the cartridge belt will unintentionally disintegrate when bent or buckled. On the other hand, the stops or abutments 23 and 24 permit the belt links 10 to be designed in such a way that the cartridge 18 is embraced or encircled to a lesser extent, whereby the comb-out or release of the cartridges 18 from the belt links 10 for feeding the cartridges 18 to a firing weapon is facilitated.

Due to the construction of the belt links 10 according to the invention individual belt sections also can be beneficially assembled without the assistance of tools. For this purpose there are provided, as shown in FIG. 2, inclined or sloped infeed guide edges 25 in addition to the stops 23 which, upon assembly of two belt sections, facilitate pushing-in of the link member 12 of one belt link 10 beneath the clamp member 11 of an adjacent belt link 10.

According to FIG. 1, the clamp member 11 comprises a recess or cutout 27 which is bounded by two marginal edges 28 extending in the circumferential direction of the cartridge 18. Two cams or dogs 29 or equivalent structure are provided at the outer ends 31 of these marginal edges 28 which define an outer end 33 of the clamp member 11, and such cams or dogs 29 form the aforementioned stops 23 and the infeed guide edges 25. According to FIG. 3, the link member 12 comprises at its outer end 32 an edge extending in the axial direction of the cartridge 18. Two cams or dogs 30 are provided at this edge and are connected to the stops or abutments 24.

While there are shown and described present preferred embodiments of the invention, it is to be distinctly understood that the invention is not limited thereto, but may be otherwise variously embodied and practiced within the scope of the following claims.

Accordingly, I claim:

1. A belt link for use with a cartridge belt composed of a plurality of adjacently interlinked ones of such belt links, each belt link comprising:

a clamp member having an inner substantially cylindrical surface;

stop means formed at said clamp member;

a link member connected with said clamp member and having an outer substantially cylindrical surface;

stop means formed at said link member;

said link member of one belt link and said clamp member of an adjacent belt link cooperating with one another in order to hold a cartridge;

said outer cylindrical surface of said link member of said one belt link being pivotably guided at said inner cylindrical surface of said adjacent belt link when said belt links are assembled to form a cartridge belt and said cartridge belt is buckled about a lengthwise axis of said cartridge;

said stop means limiting the pivoting movement of said link member of said one belt link relative to said clamp member of said adjacent belt link when said belt links are assembled to form said cartridge belt;

said clamp member and said link member each have an outer end;

said outer end of said link member being located opposite said clamp member of said belt link and containing said stop means thereof and said outer end of said clamp member being located opposite said link member of said belt link and containing said stop means thereof in order to prevent said link member of said one belt link from being pivoted out from said clamp member of said adjacent belt link;

said clamp member being provided with a recess having edges which extend in a circumferential direction of the cartridge held in such clamp member;

said edges defining external end portions of the clamp member; and said stop means defining cam means formed at said external end portions.

2. A belt link for use with a cartridge belt composed of a plurality of adjacently interlinked ones of such belt links, each belt link comprising:

a clamp member having an inner substantially cylindrical surface;

stop means formed at said clamp member;

a link member connected with said clamp member and having an outer substantially cylindrical surface;

stop means formed at said link member;

said link member of one belt link and said clamp member of an adjacent belt link cooperating with one another in order to hold a cartridge;

said outer cylindrical surface of said link member of said one belt link being pivotably guided at said inner cylindrical surface of said adjacent belt link when said belt links are assembled to form a cartridge belt and said cartridge belt is buckled about a lengthwise axis of said cartridge;

said stop means limiting the pivoting movement of said link member of said one belt link relative to said clamp member of said adjacent belt link when said belt links are assembled to form said cartridge belt;

said clamp member and said link member each have an outer end;

said outer end of said link member being located opposite said clamp member of said belt link and containing said stop means thereof and said outer end of said clamp member being located opposite said link member of said belt link and containing said stop means thereof in order to prevent said link member of said one belt link from being pivoted out from said clamp member of said adjacent belt link;

said outer end of said link member having an edge which extends in the direction of said lengthwise axis of said cartridge; and said stop means of said link member comprising two cams formed at said edge.

3. A belt link for use with a cartridge belt composed of a plurality of adjacently interlinked ones of such belt links, each belt link comprising:

a clamp member having an inner substantially cylindrical surface;

stop means formed at said clamp member;

a link member connected with said clamp member and having an outer substantially cylindrical surface;

stop means formed at said link member;

said link member of one belt link and said clamp member of an adjacent belt link cooperating with one another in order to hold a cartridge;

said outer cylindrical surface of said link member of said one belt link being pivotably guided at said inner cylindrical surface of said adjacent belt link when said belt links are assembled to form a cartridge belt and said cartridge belt is buckled about a lengthwise axis of said cartridge;

said stop means limiting the pivoting movement of said link member of said one belt link relative to said clamp member of said adjacent belt link when said belt links are assembled to form said cartridge belt;

said clamp member and said link member each having an outer end;

said outer end of said link member being located opposite said clamp member of said belt link and containing said stop means thereof and said outer end of said clamp member being located opposite said link member of said belt link and containing said stop means thereof in order to prevent said link member of said one belt link from being pivoted out from said clamp member of said adjacent belt link;

said clamp member being provided with a recess having edges which extend in a circumferential direction of the cartridge held in such clamp member;

said edges defining external end portions of the clamp member;

said stop means defining cam means formed at said external end portions; and said cam means of said clamp member comprising an infeed guide edge located at a side of said cam means which is opposite to said stop means, in order to facilitate the assembly of said link member of said one belt link and said clamp member of said adjacent belt link.

4. A belt link for use with a cartridge belt composed of a plurality of adjacently interlinked ones of such belt links, each belt link comprising:

a clamp member having an inner substantially cylindrical surface;

stop means formed at said clamp member;

a link member connected with said clamp member and having an outer substantially cylindrical surface;

stop means formed at said link member;

said link member of one belt link and said clamp member of an adjacent belt link cooperating with one another in order to hold a cartridge;

said outer cylindrical surface of said link member of said one belt link being pivotably guided at said inner cylindrical surface of said adjacent belt link when said belt links are assembled to form a cartridge belt and said cartridge belt is buckled about a lengthwise axis of said cartridge;

said stop means limiting the pivoting movement of said link member of said one belt link relative to said clamp member of said adjacen belt link when said belt links are assembled to form said catridge belt:

said clamp member and said link member each having an outer end;

said outer end of said link member being located opposite said clamp member of said belt link and containing said stop means thereof and said outer end of said clamp member being located opposite said link member of said belt link and containing said stop means thereof in order to prevent said link member of said one belt link from being pivoted out from said clamp member of said adjacent belt link;

said clamp member being provided with a recess having edges which extend in a circumferential direction of the cartridge held in such clamp member;

said edges defining external end portions of the clamp member;

said stop means defining cam means formed at said external end portions;

said belt links being capable of being assembled together to form belt sections; and said cam means of said clamp member comprising an infeed guide edge located at a side of said cam means which is opposite to said stop means, in order to facilitate the assembly of said belt sections.

5. A cartridge belt composed of a plurality of adjacently interlinked belt links, comprising, in combination:

a plurality of belt links;

each of said belt links comprising a clamp member and a link member fixed to said clamp member;

said clamp member having an inner substantially cylindrical surface;

stop means formed at said clamp member;

said link member having an outer substantially cylindrical surface;

stop means formed at said link member;

said link member of one belt link and said clamp member of an adjacent belt link cooperating with one another in order to hold a cartridge.

said outer cylindrical surface of said link member of said one belt link being pivotably guided at said inner cylindrical surface of said adjacent belt link when said belt links are assembled to form a cartridge belt and said cartridge belt is buckled about a lengthwise axis of said cartridge;

said stop means limiting the pivoting movement of said link member of said one belt link relative to said clamp member of said adjacent belt link of said cartridge belt assembled from said belt links;

said clamp member of said one belt link and said link member of said adjacent belt link conjointly acting upon a cartridge accommodated in said cartridge belt;

said clamp member and said link member each have an outer end;

said outer end of said link member being located opposite said clamp member of said belt link and containing said stop means thereof and said outer end of said clamp member being located opposite said link member of said belt link and containing said stop means thereof in order to prevent said link member of said one belt link from being pivoted out from said clamp member of said adjacent belt link;

said clamp member being provided with a recess having edges which extend in a circumferential direction of the cartridge in such clamp member;

said edges defining external end portions of the clamp member; and said stop means defining cam means formed at said external end portions.

6. A cartridge belt composed of a plurality of adjacently interlinked belt links, comprising, in combination:

a plurality of belt links;

each of said belt links comprising a clamp member and a link member fixed to said clamp member;

said clamp member having an inner substantially cylindrical surface;

stop means formed at said clamp member;

said link member having an outer substantially cylindrical surface;

stop means formed at said link member;

said link member of one belt link and said clamp member of an adjacent belt link cooperating with one another in order to hold a cartridge;

said outer cylindrical surface of said link member of said one belt link being pivotably guided at said inner cylindrical surface of said adjacent belt link when said belt links are assembled to form a cartridge belt and said cartridge belt is buckled about a lengthwise axis of said cartridge;

said stop means limiting the pivoting movement of said link member of said one belt link relative to said clamp member of said adjacent belt link of said cartridge belt assembled from said belt links;

said clamp member of said one belt link and said link member of said adjacent belt link conjointly acting upon a cartridge accommodated in said cartridge belt;

said clamp member and said link member each have an outer end;

said outer end of said link member being located opposite said clamp member of said belt link and containing said stop means thereof and said outer end of said clamp member being located opposite said link member of said belt link and containing said stop means thereof in order to prevent said link member of said one belt link from being pivoted out from said clamp member of said adjacent belt link;

said outer end of said link member having an edge which extends in a direction of said lengthwise axis of said cartridge; and said stop means of said link member comprising two cams formed at said edge.

7. A cartridge belt composed of a plurality of adjacently interlinked belt links, comprising, in combination:

a plurality of belt links;

each of said belt links comprising a clamp member and a link member fixed to said clamp member;

said clamp member having an inner substantially cylindrical surface;

stop means formed at said clamp member;

said link member having an outer substantially cylindrical surface;

stop means formed at said link member;

said link member of one belt link and said clamp member of an adjacent belt link cooperating with one another in order to hold a cartridge;

said outer cylindrical surface of said link member of said one belt link being pivotably guided at said inner cylindrical surface of said adjacent belt link when said belt links are assembled to form a cartridge belt and said cartridge belt is buckled about a lengthwise axis of said cartridge;

said stop means limiting the pivoting movement of said link member of said one belt link relative to said clamp member of said adjacent belt link of said cartridge belt assembled from said belt links;

said clamp member of said one belt link and said link member of said adjacent belt link conjointly acting upon a cartridge accommodated in said cartridge belt:

said clamp member and said link member each having an outer end;

said outer end of said link member being located opposite said clamp member of said belt link and containing said stop means thereof and said outer end of said clamp member being located opposite said link member of said belt link and containing said stop means thereof in order to prevent said link member of said one belt link from being pivoted out from said clamp member of said adjacent belt link;

said clamp member being provided with a recess having edges which extend in a circumferential direction of the cartridge held in such clamp member;

said edges defining external end portions of the clamp member;

said stop means defining cam means formed at said external end portions; and said cam means of said clamp member comprising an infeed guide edge located at a side of said cam means which is opposite to said stop means, in order to facilitate the assembly of said link member of said one belt link and said clamp member of said adjacent belt link.

8. A cartridge belt composed of a plurality of adjacently interlinked belt links, comprising, in combination:

a plurality of belt links;

each of said belt links comprising a clamp member and a link member fixed to said clamp member;

said clamp member having an inner substantially cylindrical surface;

stop means formed at said clamp member;

said link member having an outer substantially cylindrical surface;

stop means formed at said link member;

said link member of one belt link and said clamp member of an adjacent belt link cooperating with one another in order to hold a cartridge;

said outer cylindrical surface of said link member of said one belt link being pivotably guided at said inner cylindrical surface of said adjacent belt link when said belt links are assembled to form a cartridge belt and said cartridge belt is buckled about a lengthwise axis of said cartridge;

said stop means limiting the pivoting movement of said link member of said one belt link relative to said clamp member of said adjacent belt link of said cartridge belt assembled from said belt links;

said clamp member of said one belt link and said link member of said adjacent belt link conjointly acting upon a cartridge accommodated in said cartridge belt;

said clamp member and said link member each having an outer end;

said outer end of said link member being located opposite said clamp member of said belt link and containing said stop means thereof and said outer end of said clamp member being located opposite said link member of said belt link and containing said stop means thereof in order to prevent said link member of said one belt link from being pivoted out from said clamp member of said adjacent belt link;

said clamp member being provided with a recess having edges which extend in a circumferential direction of the cartridge held in such clamp member;

said edges defining external end portions of the clamp member;

said stop means defining cam means formed at said external end portions;

said belt links being capable of being assembled together to form belt sections; and said cam means of said clamp member comprising an infeed guide edge located at a side of said cam means which is opposite to said stop means, in order to facilitate the assembly of said belt sections.

* * * * *